US012140030B2

(12) United States Patent
Combe et al.

(10) Patent No.: US 12,140,030 B2
(45) Date of Patent: Nov. 12, 2024

(54) APPARATUS FOR RESIN INJECTION, MINING MACHINE AND METHOD

(71) Applicants: SANDVIK MINING AND CONSTRUCTION LYON SAS, Meyzieu (FR); SANDVIK MINING AND CONSTRUCTION OY, Tampere (FI)

(72) Inventors: Christel Combe, Meyzieu (FR); Matthieu Metzger, Meyzieu (FR); Laurent Demia, Meyzieu (FR)

(73) Assignees: SANDVIK MINING AND CONSTRUCTION LYON SAS, Meyzieu (FR); SANDVIK MINING AND CONSTRUCTION OY, Tampere (FI)

( * ) Notice: Subject to any disclaimer, the term of this patent is extended or adjusted under 35 U.S.C. 154(b) by 227 days.

(21) Appl. No.: 17/920,203

(22) PCT Filed: Apr. 23, 2021

(86) PCT No.: PCT/EP2021/060698
§ 371 (c)(1),
(2) Date: Oct. 20, 2022

(87) PCT Pub. No.: WO2021/214302
PCT Pub. Date: Oct. 28, 2021

(65) Prior Publication Data

US 2023/0184112 A1 Jun. 15, 2023

(30) Foreign Application Priority Data

Apr. 23, 2020 (EP) ..... 20171119

(51) Int. Cl.
*E21D 20/02* (2006.01)

(52) U.S. Cl.
CPC ..... *E21D 20/028* (2013.01)

(58) Field of Classification Search
CPC .... E21D 20/003; E21D 20/025; E21D 20/028
See application file for complete search history.

(56) References Cited

U.S. PATENT DOCUMENTS 10,487,655 B2 * 11/2019 Faulkner ..... E21D 20/028
2019/0145257 A1 5/2019 Faulkner et al.

FOREIGN PATENT DOCUMENTS

WO 2014190382 A1 12/2014

* cited by examiner

*Primary Examiner* — Janine M Kreck
(74) *Attorney, Agent, or Firm* — Corinne R. Gorski

(57) ABSTRACT

An apparatus for injecting grouting material, a mining machine and a method of reinforcing rock surfaces by a grouting material is provided. The apparatus includes an injector head provided with a mixing device, which are both insertable into a drilled hole. The apparatus is for feeding resin mixtures having two different setting times. The injector head is connected to a fluid inlet arrangement having a common first feed line for slow and fast resin base components and a second feed line for a resin catalyst.

9 Claims, 4 Drawing Sheets

APPARATUS FOR RESIN INJECTION, MINING MACHINE AND METHOD

RELATED APPLICATION DATA

This application is a § 371 National Stage Application of PCT International Application No. PCT/EP2021/060698 filed Apr. 23, 2021 with priority to EP 20171119.9 filed on Apr. 23, 2020.

BACKGROUND OF THE INVENTION

The invention relates to an apparatus for injecting grouting material into drilled holes when reinforcing rock surfaces with rock bolts. The drill holes are drilled by means of a rock drilling machine and thereafter the drilled holes are provided with the grouting material and finally the rock bolts are inserted and tightened. More specifically the solution relates to two setting times resin injection.

The invention further relates to a mining machine provided with an apparatus for injecting grouting material and to a method of reinforcing rock surfaces.

The field of the invention is defined more specifically in the preambles of the independent claims.

In mines, construction sites and at other work areas exists a need to reinforce rock surfaces and to thereby ensure their safety and suitability for the intended purposes. A common method for rock reinforcement is rock bolting. In such reinforcement system several rock bolts are fastened in drilled holes by grouting material. In this way rock layers are bonded together so that the risk for collapse is reduced. There are several different systems for inserting the grouting material. However, the present injecting means have shown to contain some disadvantages.

BRIEF DESCRIPTION OF THE INVENTION

An object of the invention is to provide a novel and improved apparatus for feeding grouting material to drilled holes. The invention further relates to a novel and improved mining machine and to a method of feeding grouting material when reinforcing rock surfaces.

The apparatus according to the invention is characterized by the characterizing features of a first independent apparatus claim.

The mining machine according to the invention is characterized by the characterizing features of a second independent apparatus claim.

The method according to the invention is characterized by the charactering features and steps of an independent method claim.

An idea of the disclosed solution is that bulk-like resin in fluid form is injected into drilled holes before inserting rock bolts into the drilled holes. Further, two different resins with different setting times are implemented in the injection. The grouting resin is injected by means of an apparatus comprising an injector head insertable inside the drilled hole and comprising a mixing device. The apparatus further comprises a fluid inlet arrangement connected to the injector head for feeding resin base components A1 or A2 and a resin catalyst B to the injector head. The mixing device is configured to mix the fed resin base component A1 or A2 and the catalyst B together. The injector head and the mixing device are fed together inside the drilled hole for the duration of the injection process. Further, the mentioned fluid inlet arrangement comprises two separate feed lines. A first feed line can alternatively be selected for feeding a first basic resin component A1 or a second resin base component A2, and a second feed line is for feeding the resin catalyst B. In other words, the fluid inlet arrangement is provided with only two feed lines for feeding grouting resin material into the drilled hole. The basic resin components A1 and A2 have different setting times when they are mixed with the catalyst B. The catalyst B is a hardener for a chemical reaction to start turning the resin from a liquid to a solid.

An advantage of the disclosed solution utilizing only two feed lines for the resin components is that the diameter of the drilled hole may be smaller compared to solutions implementing a greater number of feed lines. When the diameter of the drilled hole is smaller, it can be drilled more effectively, quicker and with less energy consumption. Diameters of the rock bolts are typically between 14 to 18 mm whereby relatively small diameter holes are sufficient for them. Further, minor amount of resin is needed for the grouting because the hole is well adapted to the mentioned small bolt diameter. The disclosed injection head and the feed lines are able to fit in a very small hole, diameter of which may be as small as 30-35 mm. In such small diameter holes it is difficult to add any extra hose to manage a second component without increasing pressure drop in the feeding.

A further advantage is that when the mixing device is at the injector head, the resin base component A1 or A2 is mixed with the resin catalyst B as late as possible before being injected to the drilled hole. It means that only a small amount of resin material is wasted when the injection head and the mixing device needs to be cleaned between injection measures of drilled holes.

Moreover, the disclosed solution provides a system for feeding two resin mixtures with different setting times whereby the drilled hole can be provided with a fast setting resin mixture at the bottom and a slow setting resin mixture following the fast setting mixture. The injection head is retracted at the same time during the injection process.

A further advantage of the disclosed solution is that the structure may be simple and durable when compared to the known solutions provided with complicated injection adaptors.

The disclosed solution may be implemented in different rock drilling rigs and bolting jumbos. The system may also be easily retrofitted to the existing mining devices.

The apparatus comprises a resin pumping arrangement provided with two pumps. Thus, there is a common first feed pump configured to feed alternatively the first resin base component A1 or the second resin base component A2 to the first feed line. Further, a second feed pump is dedicated for feeding the resin catalyst B to the second feed line.

According to an embodiment, the first feed pump and the second feed pump, mentioned in the previous embodiment, are volumetric pumps. The pumps are configured to operate synchronously, whereby volume of the fed resin base component A1 or A2 in relation to the fed catalyst B is substantially constant.

According to an embodiment, the above mentioned volumetric pump may be a pump provided with a chamber with a predetermined volume inside which may be a batch of material to be fed. Then a piston, plunger or gear element compresses the material to the feed line. Thus, the pump may be a piston type pump or a gear pump, for example.

According to an embodiment, ratio between the fed volumes of the selected resin base component (A1 or A2) and the catalyst B is generally 1:1 but it may take other values, such as 2:1, 1:2 or 3:1.

According to an embodiment, the first feed pump and the second feed pump are powered by means of a common actuator. The shared actuator may be a motor and the pumps may be connected on a same output shaft of the motor. An advantage of the use of the one common actuator is that the pumps are then being driven automatically in a synchronized manner. The ratio of the fed volumes of the resin base component (A1 or A2) and the catalyst B is fixed. Then the pumping is simple to control.

In an alternative solution, the pumps are separately operated pumps but are controlled in a synchronous manner. The phrase "synchronously operated" means that the pumps can be managed or regulated at the same speed, or alternatively, they can be managed or regulated according to a flowrate measurement on each line.

The apparatus comprises at least one feed valve for selectively connecting an inlet channel of the common first feed pump to a first container provided for the first resin base component A1, or to a second container provided for the second resin base component A2.

According to an embodiment, the injector head is a grouting resin feeding tool, whereby the tool is removed from the drilled hole when the resin feeding is completed and before a separate rock bolt is fed into the drilled hole filled with the grouting resin. Thus, the injector head is not left inside the drilled hole but it is used for several times for several drilled holes. In other words, the injector head and the mixer device are not single used devices. Further, the injector head and the mixing device are separate from a rock bolt.

According to an embodiment, the injection head is retracted inside the drilled hole towards the opening of the hole while injecting the resin mixture. The speed of retraction is correlated with the resin flowrate and hole diameter. The speed of retraction may also take into account possible cracks, voids or other spaces that needs to be filled.

According to an embodiment, the drilled holes may be equipped with rock bolts, rock anchors, cables or corresponding elongated metallic reinforcing elements after the grouting material has been injected. Thus, there are several alternative rock reinforcements that can be mounted inside the drill holes.

According to an embodiment, the apparatus comprises a solvent feeding system configured to feed solvent medium for flushing the injector head and the mixing device. The aim of the system is to prevent clogging in situations when there are breaks between the injections of the drilled holes. The solvent feeding system comprises a third pump for pumping the solvent medium from a third container.

According to an embodiment, the fed solvent medium is a solvent or a grease or a gel (high viscosity) or a water based mixture.

According to an embodiment, the resin material mixed in the mixing device is flushed by means of the solvent medium out of the injector head. The system may be cleaned by pushing the mixed material outside of the mixing head, outside the drilled hole or to a top of the drilled hole just after the actual grouting resin material is being fed. This way the system is cleaned and can wait between treating several holes. The solvent mixture is removed afterwards and replaced by the resin mixture by pushing the solvent mixture outside of the mixing head, to a bottom of the drilled hole before actual grouting resin material is being fed or to the ground i.e. outside the drilled hole.

According to an embodiment, solvent feeding system comprises a dedicated third feed line for feeding the solvent medium from the third pump to the mixing device.

According to an embodiment, the solvent feeding system is alternatively connectable to the first feed line and/or to the second feed line through a solvent valve. Thus, the system utilizes the shared feed line of the resin base component. This is particularly valid when high viscosity solvent (like grease or gel) is used, since then there will be a piston effect in the hose to clean the feed line. It should be noted that the solvent is fed only for a certain amount of time or volume, just to clean the mixing device and the injection head. The solvent may also be pumped in an alternative or sequential way.

According to an embodiment, the disclosed apparatus is connectable to a mining machine. Then a feed device of the mining machine is configured to insert and move the injector head and the mixing device inside the drilled hole.

According to an embodiment, the disclosed solution relates also to a mining machine comprising: a movable carrier; one or more booms connected movably on the carrier; an apparatus for injecting grouting resin into drilled holes; and one or more bolting units at a distal end of the booms for feeding rock bolts or corresponding elongated reinforcements into the drilled holes after being injected with the grouting resin. The boom is provided with a feed device for moving an injection head of the injecting apparatus inside the drilled hole. The injecting apparatus of the mining machine is in accordance with the features disclosed in this document.

According to an embodiment, the disclosed solution relates also to a method of injecting grouting resin into several drilled holes, wherein the method comprises: inserting an injector head inside the drilled hole; providing the injector head with a mixing device; feeding a basic resin component A and a resin catalyst B to the injector head by means of a fluid inlet arrangement; mixing the fed basic resin component and the resin catalyst to a resin mixture inside the drilled hole by means of the mixing device; initiating injection of the resin mixture at a bottom part of the drilled hole and moving the injector head and the mixing device towards the opening of the drilled hole during the injection; completing the injection and removing the injection head from the drilled hole; and mounting a metallic rock reinforcement inside the drilled hole provided with the grouting resin. The method further comprises: injecting in sequence two different resin mixtures with different setting times into the drilled hole; providing the fluid inlet arrangement with two resin feed lines; feeding in a selective order through a first feed line a first resin base component A1 and a second resin base component A2 with different setting times. The resin catalyst B is feed through a second feed line simultaneously with the selected basic component A1 or A2.

According to an embodiment, the aim of the solution is to provide the drilled hole with two or more resin sections inside the drilled hole with different setting times in order to implement a so called spring effect of a rock bolt. In this embodiment the bottom of the drilled hole is provided with shorter setting time and the rest of the drilled hole with longer setting time. When the bottom cures faster, it is possible to tighten the rock bolt before the rest of the resin material is cured, whereby the rock bolt can be pre-tensioned.

According to an embodiment, the mixing device comprises screw surfaces, spirals, a maze or corresponding form surfaces for causing the fed two separate resin component fluid flows to be mixed and to form one homogenous resin mass. The mixing device or element in connection with the injector head is a static mixer with several non-movable mixing elements or surfaces for mixing the fed components together prior being ejected from the injector head. Structure of the mixing device may be designed so that the mentioned mixing elements are easy and quick to substitute and clean when needed. The mixing device may comprise cartridge type mixing elements for facilitating servicing. Further, the mixing device is dimensioned so that it can be inserted inside drilled holes with small diameters.

According to an embodiment, the disclosed injecting system comprises one or more control units for controlling feeding and quantities of needed resin components selectively (feeding slow resin, fast resin, catalyst, inhibitor), flushing the feed line (solvent feeding), and controlling movements of the injecting head (feeding and retracting) inside the drilled hole. The control unit may be provided with one or more injection sequence and the system may be provided with automated operational modes. The control unit may control the feeding of the resin (flowrate) and retract movement of the injection head in response to a diameter of the drill hole. Then the controllable parameters are at least flow rate and movement rate.

The above disclosed embodiments and features may be combined in order to form suitable solutions having those of the above features that are needed.

BRIEF DESCRIPTION OF THE FIGURES

Some embodiments are described in more detail in the accompanying drawings, in which.

For the sake of clarity, the figures show some embodiments of the disclosed solution in a simplified manner. In the figures, like reference numerals identify like elements.

DETAILED DESCRIPTION OF SOME EMBODIMENTS

Figure 1:
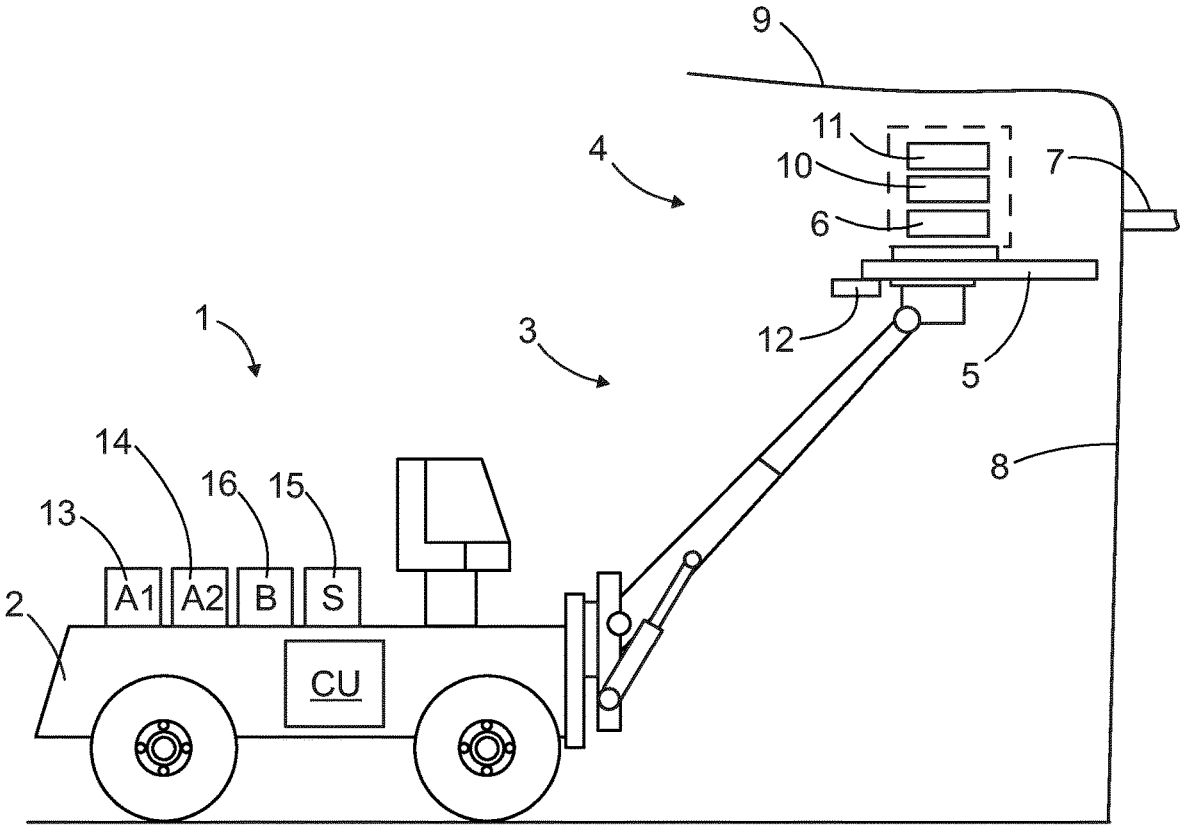
FIG. 1 is a schematic side view of a rock drilling rig intended for underground drilling and rock reinforcing.

FIG. 1 shows a rock drilling rig, which is an example of a mining machine 1. The rock drilling rig comprises a movable carrier 2 and at least one boom 3 connected to the carrier 2. At a distal end portion of the boom 3 is a drilling unit or bolt insertion unit 4. The unit 4 may comprise a feed beam 5 and a rock drilling machine 6 supported on it. A drilling tool is connectable to the rock drilling machine 6. The rock drilling machine 6 comprises at least a rotating device for rotating the drilling tool around its longitudinal axis. The rock drilling machine 6 and the boom 3 may be turned so that drill holes 7 can be drilled to walls 8 and ceilings 9 of tunnels and other underground spaces in order to mount reinforcing rock bolts. The unit 4 may also be provided with a bolting unit 10 and an apparatus 11 for feeding grouting resin mixtures. The drilling machine 6, the bolting unit 10 and the resin feeding apparatus 11 may be connected to the drilling unit 4 so that they can be indexed on central axis of the drilled hole 7, or alternatively they all or some of them can be mounted to dedicated booms or other support structures. At the distal end of the boom 3 is at least one feed device 12 for moving the devices 6, 10, 11 relative to the distal end of the boom 3. Further, on the carrier 2 there may be a first container 13 provided for a first resin base component A1, a second container 14 provided for a second resin base component A2, a third container 15 for a solvent medium S and a fourth container 16 for a resin catalyst B.

Figure 2:
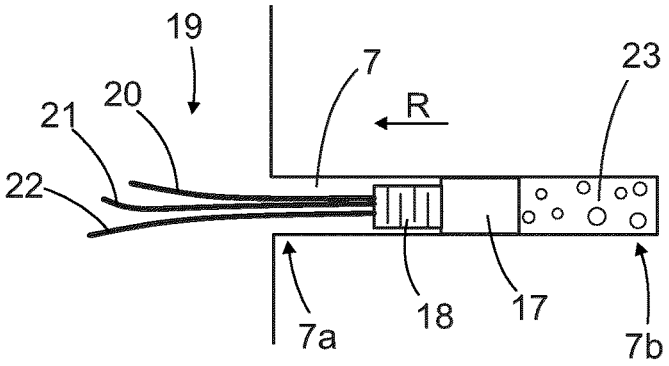
FIG. 2 is a schematic side view of an arrangement system for feeding grouting material to a drilled hole.

FIG. 2 discloses a drilled hole 7 provided with an opening 7*a* and a bottom 7*b*. Inside the drilled hole 7 is inserted an injector head 17 provided with a mixing device 18. The injector head 17 is connected to a fluid inlet arrangement 19 comprising a first feed line 20, a second feed line 21 and an optional third feed line 22. The first feed line 20 is a common feed line for components A1 and A2, whereas the second feed line is dedicated for the component B. The third feed line 22 is for feeding the solvent agent S, but the system may be without any third line 22 if line 20 or 21 is used for solvent feeding. The feed lines 20-22 may be hoses or tubes. In FIG. 2 resin mixture 23 is fed through the injector head 17 and the mixing device 18 to the bottom 7*b* of the drilled hole 7. The system is retracted R simultaneously during the injection.

Figure 3:
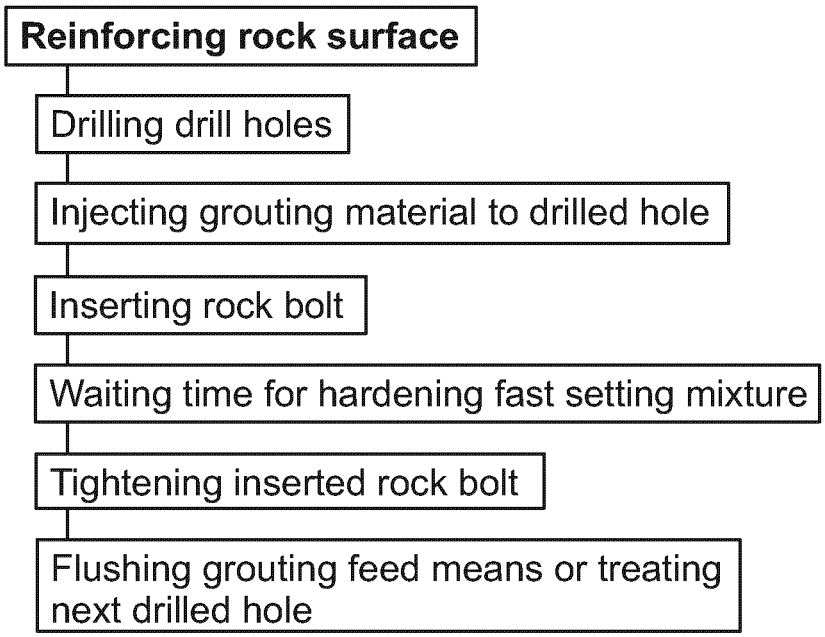
FIG. 3 is a schematic diagram showing some features relating to reinforcing measures of a rock surface.

FIG. 3 discloses steps relating to reinforcing rock surfaces. These issues have already been discussed above in this document.

Figure 4:
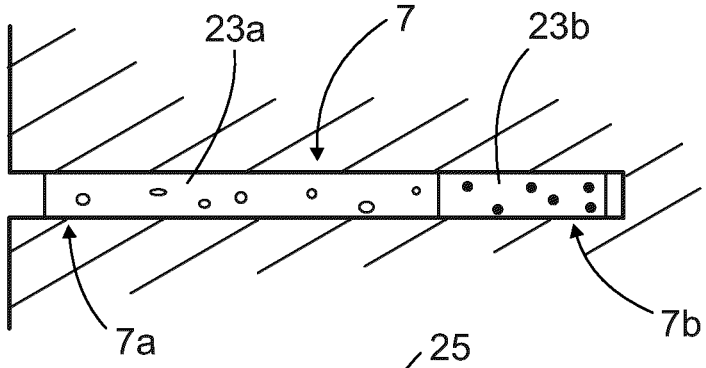
FIG. 4 is a schematic side view of a drilled hole after being filled with two types of resin material.

FIG. 4 discloses that a drilled hole 7 is filled with two types of resin mixtures 23*a*, 23*b*. At a bottom 7*b* of the drilled hole 7 there is injected a fast setting resin mixture 23*b* and the rest of the drilled hole up to an opening 7*a* of the hole 7, or close to it, is filled with a slow setting resin mixture 23*a*.

Figure 5:
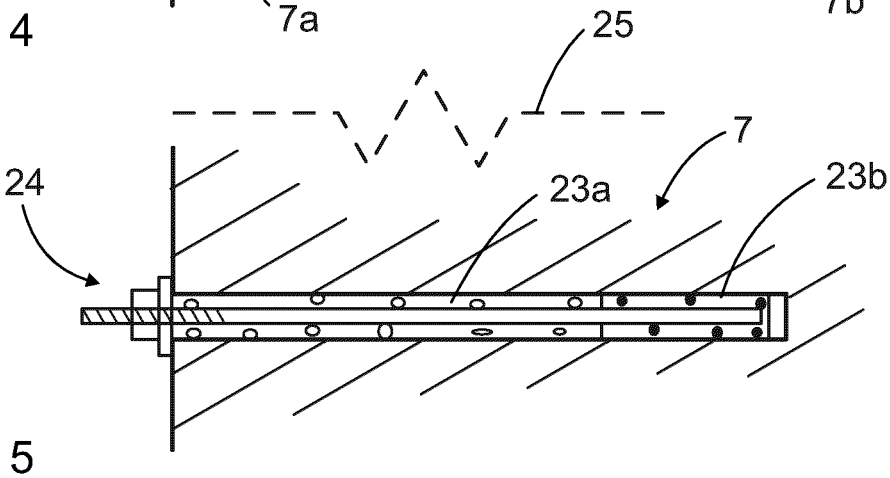
FIG. 5 is a schematic side view of the drilled hole of FIG. 4 after being equipped with a rock bolt.

In FIG. 5 a rock bolt 24 is pushed into the drilled hole 7 so that its distal end extends to the mentioned fast setting resin mixture 23*b* which hardens rapidly and locks the end of the rock bolt 24. Thereafter the rock bolt 24 can be tightened before the slow setting resin mixture 23*a* hardens. This way a spring effect can be achieved. The spring effect is illustrated by means of broken lines 25 between the bottom of the hole 7*b* and the opening 7*a*.

Figure 6:
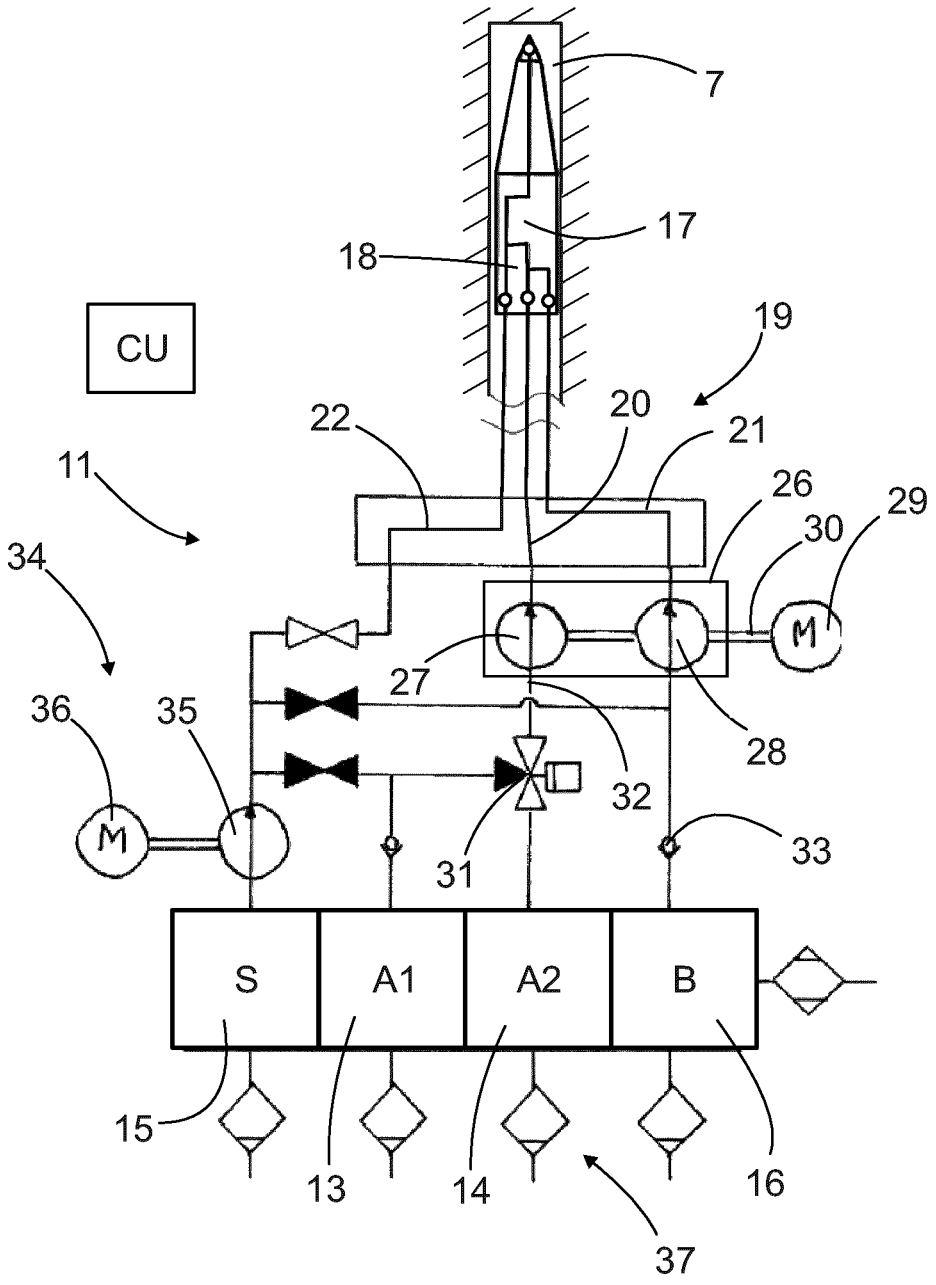
FIG. 6 is schematic view of an apparatus for injecting grouting material to a drilled hole.

FIG. 6 discloses a grouting resin feed system and apparatus 11. Many of the features have already been shown and discussed in the previous Figures. There are containers 13-16 for the resin components A1, A2 and B, and also for the solvent S. Also the injector head 17 inserted inside the drilled hole 7 and provided with the feed lines 20-22 is already discussed. However, FIG. 6 shows some additional issues relating to the pumping of the resin components A1, A2, B and the solvent S. The apparatus 11 comprises a resin pumping arrangement 26 provided with two pumps 27 and 28. A common first feed pump 27 is configured to feed alternatively the first resin base component A1 or the second resin base component A2 to the first feed line 20. A second feed pump 28 is dedicated for feeding the catalyst B to the second feed line 21. Further, the first feed pump 27 and the second feed pump 28 are volumetric pumps and are configured to operate synchronously, whereby volume of the fed resin base component A1 or A2 in relation to the fed catalyst B is constant. The first feed pump 27 and the second feed pump 28 may be powered by means of a common actuator 29, such as a motor M. The pumps 27, 28 may be connected to a common output shaft 30 of the motor M. The apparatus 11 comprises at least one feed valve 31 for selectively connecting an inlet channel 32 of the common first feed pump 27 to a first container 13 provided for the first resin base component A1, or to a second container 14 provided for the second resin base component A2. The second feed pump 28 is always connected to the fourth container 16. There may be check valves 33 in the resin feed lines.

The apparatus further comprises a solvent feeding system 34 configured to feed solvent medium S for flushing the injector head 17 and the mixing device 18. The solvent feeding system 34 comprises a third pump 35 for pumping the solvent medium S from a third container 15. The pump 35 may be actuated by means of an actuator 36, which may be a motor M, for example. There is a dedicated third feed line 22 for feeding the solvent medium S from the third pump 35 to the mixing device 18.

A control unit CU may control operation of the disclosed system and related pumps, actuators and valves.

FIG. 6 further discloses that the containers 13-16 may be connected to pressurization or desiccant/vent dryer systems 37 for facilitating feeding of their content.

It should be noted that the apparatus 11 disclosed in FIG. 6 may also be implemented with slightly different components and arrangements. For instance, a pump can be dedicated to A1 and another pump for A2 and a third pump for B.

Figure 7:
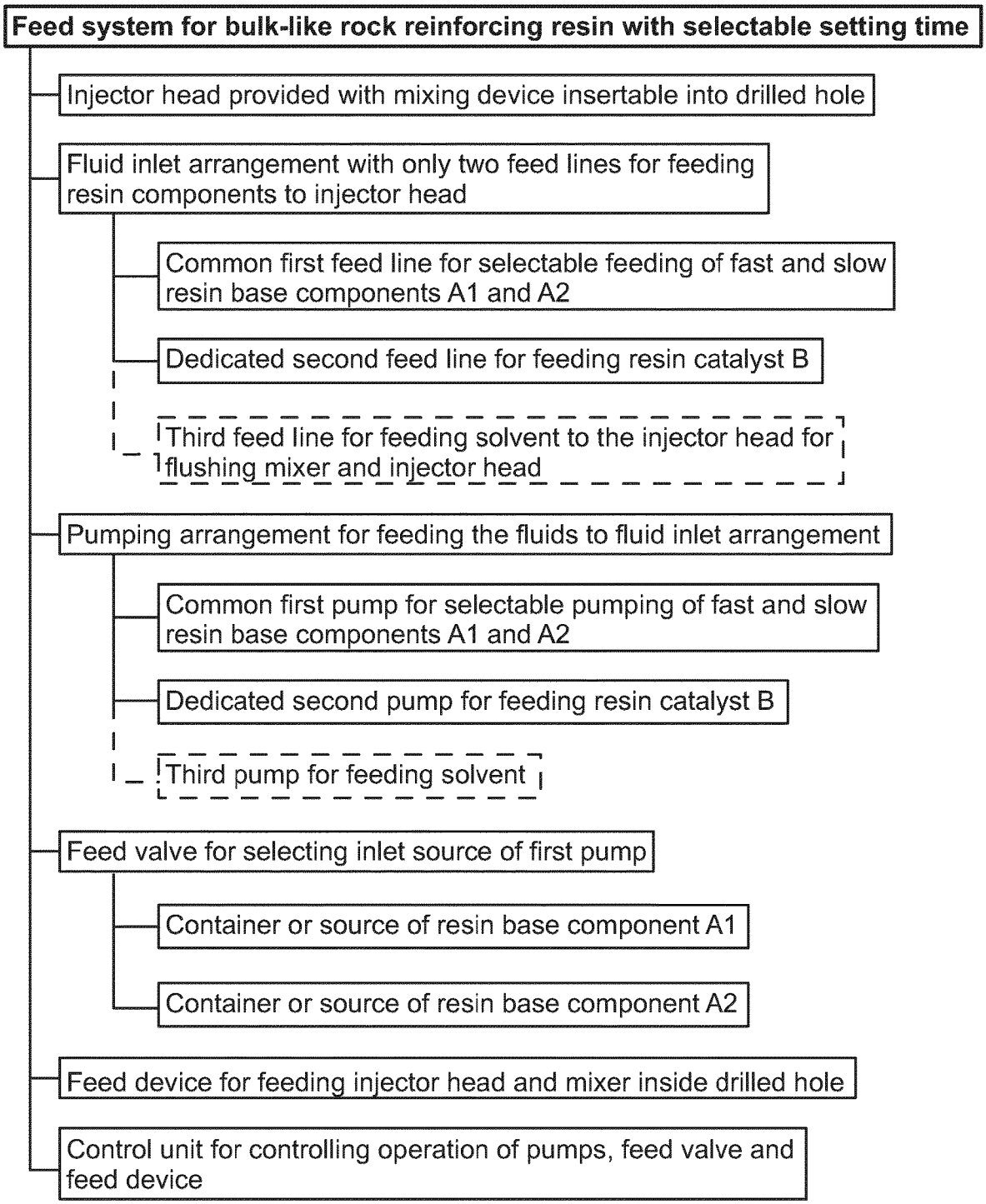
FIG. 7 is a diagram showing some principles and features relating to the rock reinforcing.

FIG. 7 is a simplified diagram illustrating some issues disclosed in this document.

The drawings and the related description are only intended to illustrate the idea of the invention. In its details, the invention may vary within the scope of the claims.

The invention claimed is:

1. An apparatus for injecting grouting resin into a drilled hole for rock reinforcement, the apparatus comprising:

an injector head insertable inside the drilled hole, the injector head being a grouting resin feeding tool, whereby the tool is removed from the drilled hole when the resin feeding is completed and before a separate rock bolt is fed into the drilled hole filled with the grouting resin;

at least one fluid inlet arrangement connected to the injector head for feeding a resin base component and a resin catalyst to the injector head, the injector head including a mixing device arranged for mixing the fed resin base component and the resin catalyst together, whereby the mixing device is configured to be fed together with the injector head inside the drilled hole, and wherein the fluid inlet arrangement includes two separate feed lines, wherein a first feed line is selectable for alternative feeding of a first resin base component and a second resin base component the first and second resin base components having different setting times, and wherein a second feed line is for the resin catalyst;

a resin pumping arrangement provided with two feed pumps, wherein a common first feed pump is configured to feed alternatively the first resin base component or the second resin base component to the first feed line and a second feed pump is arranged for feeding the resin catalyst to the second feed line; and at least one feed valve arranged for selectively connecting an inlet channel of the common first feed pump to a first container provided for the first resin base component, or to a second container provided for the second resin base component.

2. The apparatus as claimed in claim 1, wherein the first feed pump and the second feed pump are volumetric pumps and are configured to operate synchronously, whereby volume of the fed first or second resin base component in relation to the fed resin catalyst is constant.

3. The apparatus as claimed in claim 1 or 2, wherein the first feed pump and the second feed pump are powered by means of a common actuator.

4. The apparatus as claimed in claim 1, further comprising a solvent feeding system configured to feed a solvent medium for flushing the injector head and the mixing device, wherein the solvent feeding system includes a third pump for pumping the solvent medium from a third container.

5. The apparatus as claimed in claim 4, wherein the solvent feeding system includes a dedicated third feed line arranged for feeding the solvent medium from the third pump to the mixing device.

6. The apparatus as claimed in claim 1, wherein the apparatus is controlled by a control unit, wherein a sequence of insertion between the first or second base resin components and the resin catalyst (A1+B; A2+B), and potentially a solvent, are managed according to time or flow measurement or pump movement measurement.

7. The apparatus as claimed in claim 1, wherein the apparatus is connectable to a mining machine, and wherein a feed device of the mining machine is configured to insert and move the injector head and the mixing device inside the drilled hole.

8. A mining machine comprising:

a movable carrier;

at least one boom connected movably on the carrier;

an apparatus for injecting grouting resin into drilled holes;

at least one bolting unit at a distal end of the boom for feeding rock bolts into the drilled holes after being injected with the grouting resin, wherein the boom is provided with a feed device arranged for moving an injection head of the injecting apparatus inside the drilled hole; and an apparatus in accordance with claim 1 being arranged for injecting the grouting resin.

9. A method of injecting grouting resin into several drilled holes, the method comprising:

inserting an injector head inside a drilled hole;

providing the injector head with a mixing device, whereby the mixing device is inserted together with the injector head inside the drilled hole;

feeding a resin base component and a resin catalyst to the injector head by means of a fluid inlet arrangement;

mixing the fed resin base component and the resin catalyst to form a resin mixture inside the drilled hole by means of the mixing device;

initiating injection of the resin mixture at a bottom part (7*b*) of the drilled hole and moving the injector head and the mixing device towards an opening of the drilled hole during the injection;

completing the injection and removing the injection head from the drilled hole;

inserting a metallic rock reinforcement inside the drilled hole provided with the grouting resin;

injecting in sequence two different resin mixtures with different setting times into the drilled hole;

providing the fluid inlet arrangement with two feed lines, wherein a first feed line is selectable with a feed valve for alternative feeding of a first resin base component and a second resin base component each having different setting times, and wherein a second feed line is for the resin catalyst;

feeding in a selective order through the first feed line the first resin base component A1 and the second resin base component A2; and feeding through the second feed line the resin catalyst simultaneously with the selected first or second resin base component.

* * * * *